US010619821B2

(12) United States Patent
Ogawa et al.

(10) Patent No.: US 10,619,821 B2
(45) Date of Patent: Apr. 14, 2020

(54) ELECTRONIC UNIT AND CASE WITH RECESSED LIGHT-TRANSMISSION PORTION

(71) Applicant: YAZAKI CORPORATION, Tokyo (JP)

(72) Inventors: Kikuo Ogawa, Makinohara (JP); Hitoshi Tsugane, Makinohara (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 16/038,369

(22) Filed: Jul. 18, 2018

(65) Prior Publication Data

US 2019/0063720 A1 Feb. 28, 2019

(30) Foreign Application Priority Data

Aug. 30, 2017 (JP) ..... 2017-165364

(51) Int. Cl.

| | |
|---|---|
| ***F21V 3/02*** | (2006.01) |
| ***F21V 3/06*** | (2018.01) |
| ***F21V 15/04*** | (2006.01) |
| ***F21V 15/01*** | (2006.01) |
| ***F21V 33/00*** | (2006.01) |
| *F21Y 115/10* | (2016.01) |
| *F21W 111/00* | (2006.01) |
| *F21V 31/00* | (2006.01) |

(52) U.S. Cl.

CPC ..... *F21V 3/02* (2013.01); *F21V 3/062* (2018.02); *F21V 15/01* (2013.01); *F21V 15/04* (2013.01); *F21V 33/0052* (2013.01); *F21V 31/005* (2013.01); *F21W 2111/00* (2013.01); *F21Y 2115/10* (2016.08)

(58) Field of Classification Search

CPC ..... F21Y 2107/30; H01L 2924/181; H01L 33/54; B60Q 3/64; B60Q 1/2611; B60Q 1/2696; B60Q 2500/10; B60Q 3/51

USPC ..... 362/459–549

See application file for complete search history.

(56) References Cited

U.S. PATENT DOCUMENTS 8,648,371 B2 * 2/2014 Kuo ..... G02F 1/157 362/465

2001/0012199 A1 8/2001 Kinoshita et al.

(Continued)

FOREIGN PATENT DOCUMENTS

JP 59-104555 U 7/1984

JP 2001-298289 A 10/2001

(Continued)

*Primary Examiner* — William J Carter

(74) *Attorney, Agent, or Firm* — Sughrue Mion, PLLC

(57) ABSTRACT

An electronic unit includes a circuit board, a light emitter mounted on one side of the circuit board and configured to emit a light, and a resin case accommodating the circuit board on which the light emitter is mounted. The resin case includes a first light-transmission portion configure to transmit the light emitted from the light emitter to outside of the resin case so as to be bright in desired luminance when viewed from the outside. The first light-transmission portion includes an outer-surface-side concave portion which is formed by recessing an outer surface of the resin case so that a thickness of the first light-transmission portion is thinner than a thickness of the resin case except for the first light-transmission portion.

9 Claims, 14 Drawing Sheets

(56) References Cited

U.S. PATENT DOCUMENTS

| | | | | |
|---|---|---|---|---|
| 2005/0105296 | A1* | 5/2005 | French | B60D 1/60<br>362/485 |
| 2014/0268858 | A1* | 9/2014 | Norris | F21S 43/20<br>362/545 |

FOREIGN PATENT DOCUMENTS

| | | | |
|---|---|---|---|
| JP | 2008-44489 | A | 2/2008 |
| JP | 2009-177164 | A | 8/2009 |
| JP | 2016-25739 | A | 2/2016 |

* cited by examiner

ELECTRONIC UNIT AND CASE WITH RECESSED LIGHT-TRANSMISSION PORTION

CROSS REFERENCE TO RELATED APPLICATIONS

This application is based on Japanese Patent Application (No. 2017-165364) filed on Aug. 30, 2017, the contents of which are incorporated herein by way of reference.

BACKGROUND

The present invention relates to an electronic unit having a configuration and a structure for accommodating a circuit board in a resin case.

In recent years, there has been an increase in proposals relating to wireless communication from outside to a device mounted on a vehicle or wireless communication while riding in a vehicle (see JP-A-2008-44489, for example).

SUMMARY

An electronic unit according to the invention is characterized by the following (1) to (9).

(1) An electronic unit including:

a circuit board;

a light emitter mounted on one side of the circuit board and configured to emit a light; and a resin case accommodating the circuit board on which the light emitter is mounted, wherein the resin case includes a first light-transmission portion configure to transmit the light emitted from the light emitter to outside of the resin case so as to be bright in desired luminance when viewed from the outside, and the first light-transmission portion includes an outer-surface-side concave portion which is formed by recessing an outer surface of the resin case so that a thickness of the first light-transmission portion is thinner than a thickness of the resin case except for the first light-transmission portion.

(2) The electronic unit according to (1), wherein the outer-surface-side concave portion is indicative of a position of the first light-transmission portion.

(3) The electronic unit according to (1), wherein a distance between the light emitter and an inner surface of the first light-transmission portion is longer than a distance between a central axis of the resin case and the inner surface of the first light-transmission portion.

(4) The electronic unit according to (1), wherein the resin case is resin-molded into a bottomed tubular shape and a one-piece state.

(5) The electronic unit according to (3), wherein the resin case includes a second light-transmission portion which is provided around the first light-transmission portion, and the second light-transmission portion is configured to transmit light emitted from the light emitter to the outside of the resin case so as to be bright in a luminance lower than the desired luminance.

(6) The electronic unit according to (4), further including:

a housing engaged with the resin case; and a sealing member which is in close contact with an opening portion of the resin case and the housing therebetween.

(7) The electronic unit according to (6), further including:

a rubber holder which is attached to an outer surface of a body of the resin case and detachable with respect to a bracket as a fixing target.

(8) The electronic unit according to (7), wherein the resin case includes a stopper portion disposed in the outer surface of the resin case and configured to position with respect to the holder.

(9) The electronic unit according to (7), wherein the holder includes a holder body, a cover portion which covers an outside of the bottomed portion of the resin case, and a through hole exposing the first light-transmission portion to the outside of the cover portion is formed in the cover portion so as to.

DETAILED DESCRIPTION OF EXEMPLIFIED EMBODIMENTS

In order to provide an electronic unit such as a communication unit for performing wireless communication, for example, the inventor of the invention intends to make it possible to recognize, at a glance, an operating state of the electronic unit, that is, whether or not the electronic unit is in operation.

The invention has been made in view of the above circumstances and an object thereof is to provide an electronic unit in which an operating state can be recognized at a glance.

A communication unit which is an embodiment of the electronic unit can be mounted not only on vehicles such as automobiles and motorcycles, but also on agricultural machinery and construction machinery and, for example, those capable of carrying out short-range wireless communication with a cellular phone, a portable information terminal or the like by Bluetooth (registered trademark) correspond thereto. The communication unit includes a circuit board for communication, a light emitter mounted on one surface side of the circuit board, and a resin case for accommodating a circuit board on which the light emitter is mounted. The resin case includes a light-transmission portion which is irradiated by light of the light emitter and can secure desired luminance when viewed from the outside. The light-transmission portion includes an outer-surface-side concave portion, a thin portion, and a marking portion.

Figure 1:
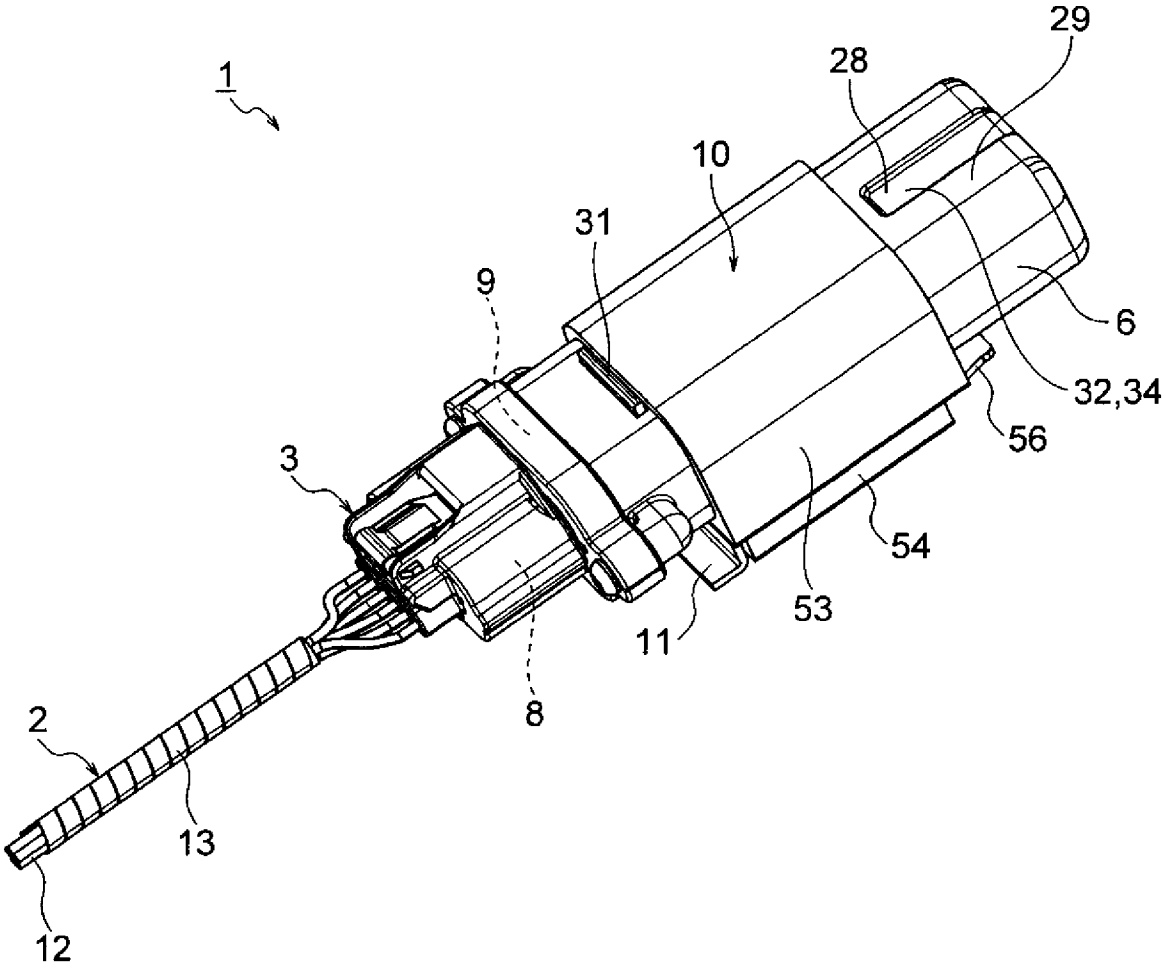
FIG. 1 is a perspective view of a communication unit which is an embodiment of an electronic unit of the invention (First embodiment).
Figure 2:
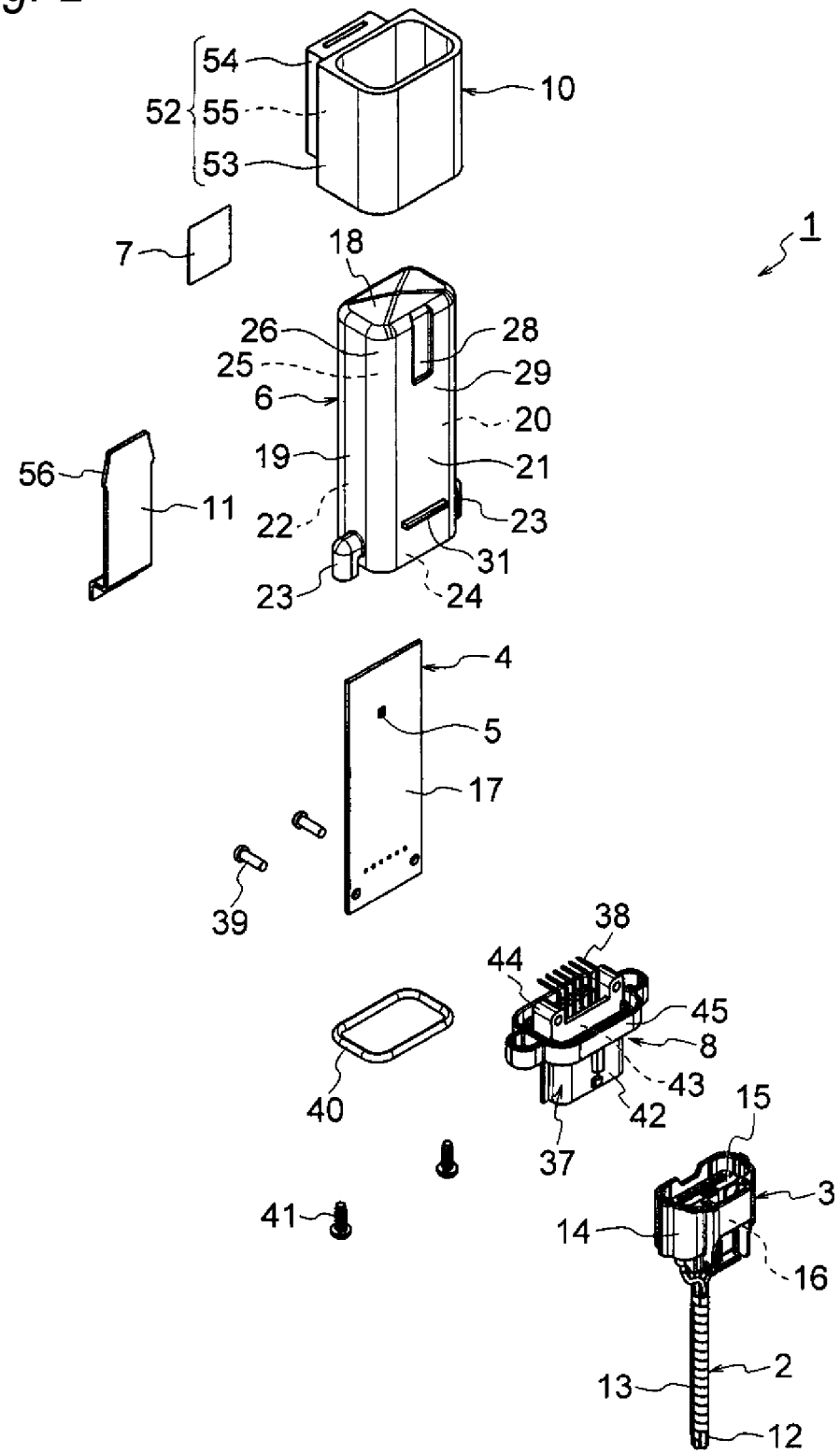
FIG. 2 is an exploded perspective view of the communication unit.
Figure 3:
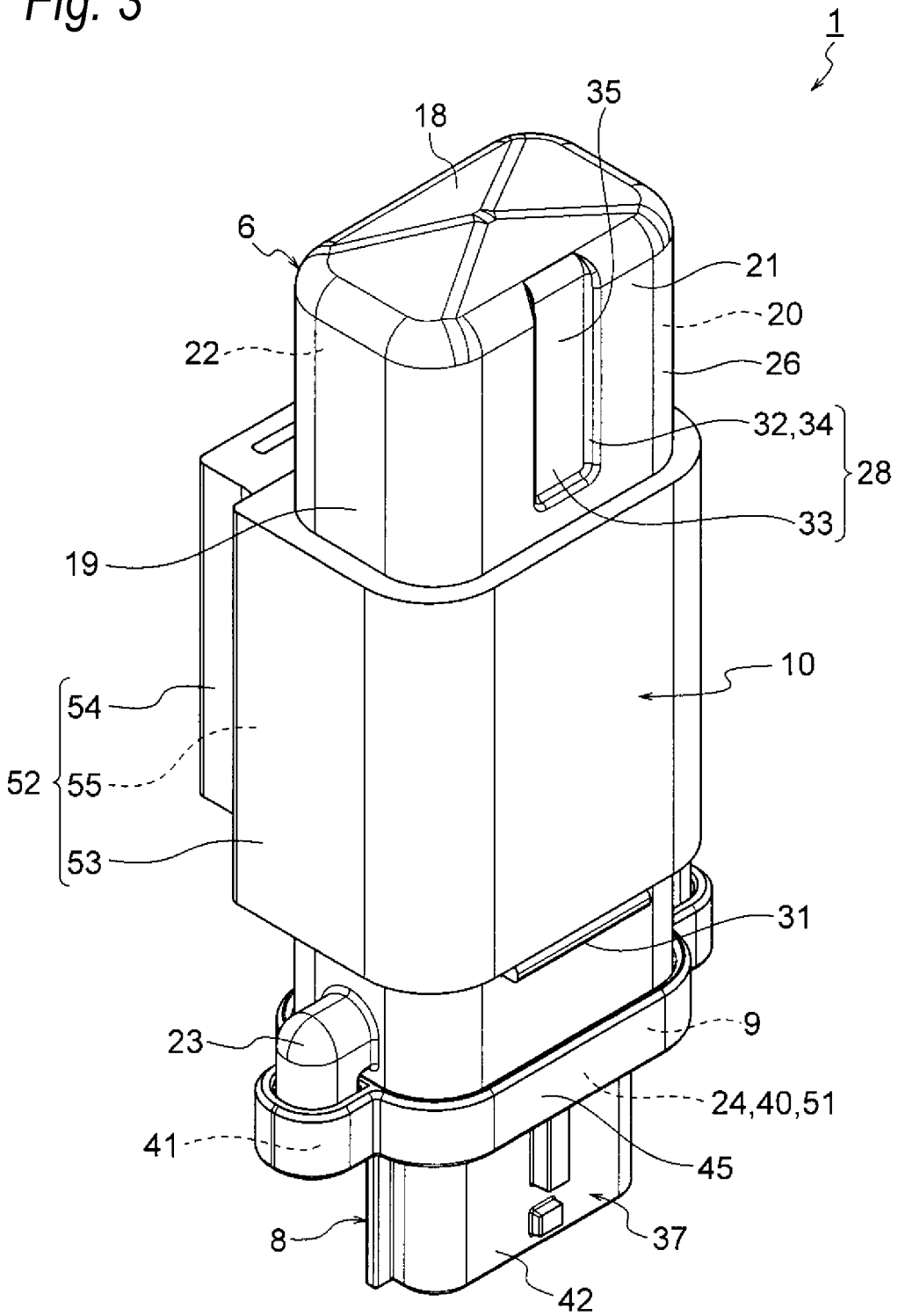
FIG. 3 is a perspective view of the communication unit as viewed from the front side.
Figure 4:
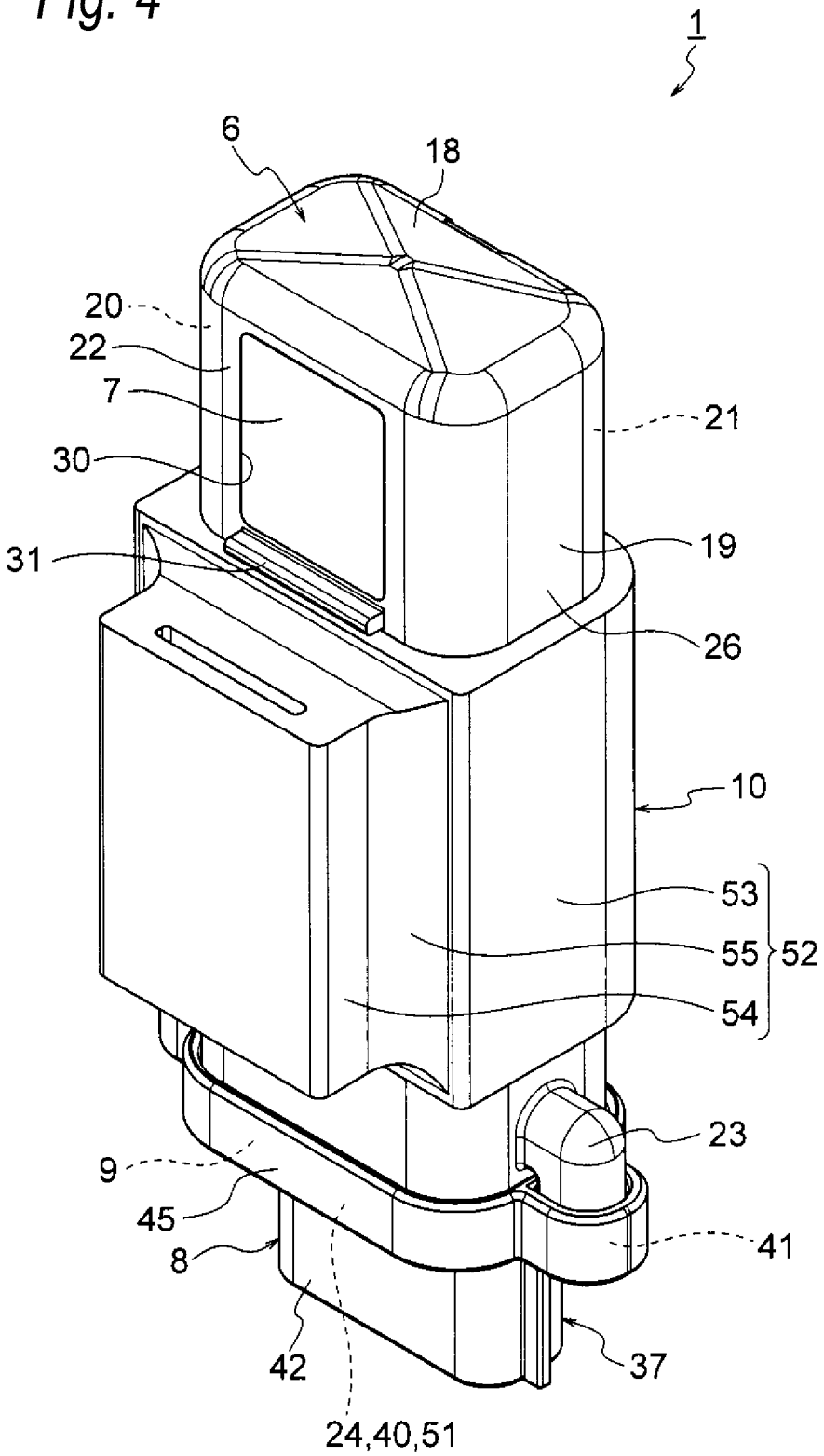
FIG. 4 is a perspective view of the communication unit as viewed from the rear side.
Figure 5B:
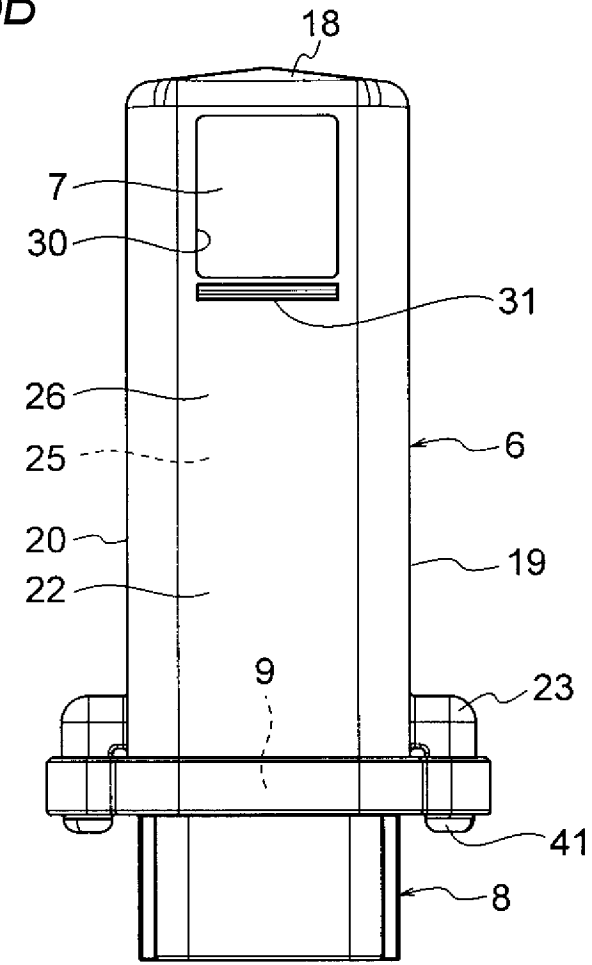
FIG. 5B is a view before a holder is attached.
Figure 5A:
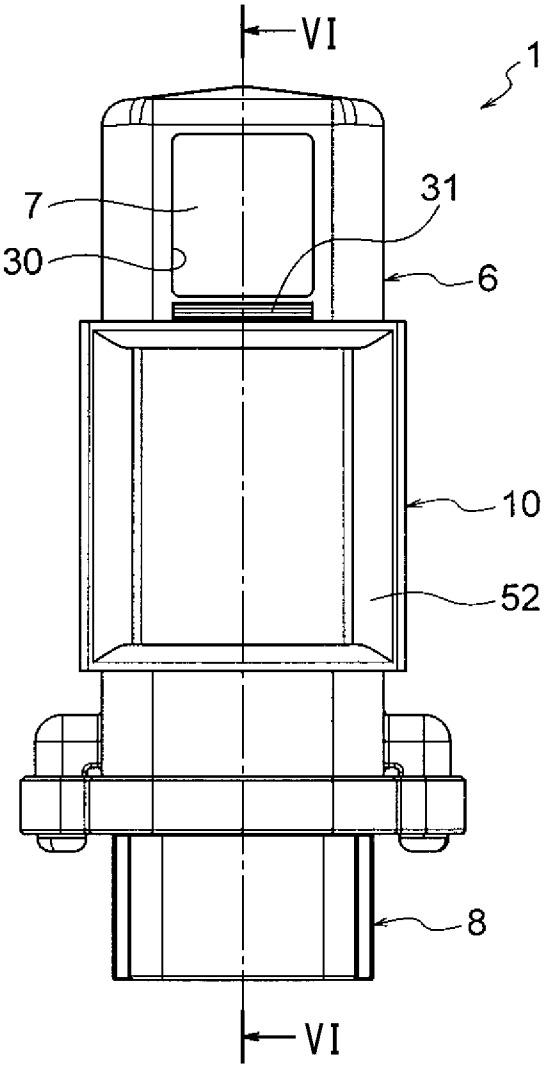
FIG. 5A is a rear view of the communication unit.
Figure 6:
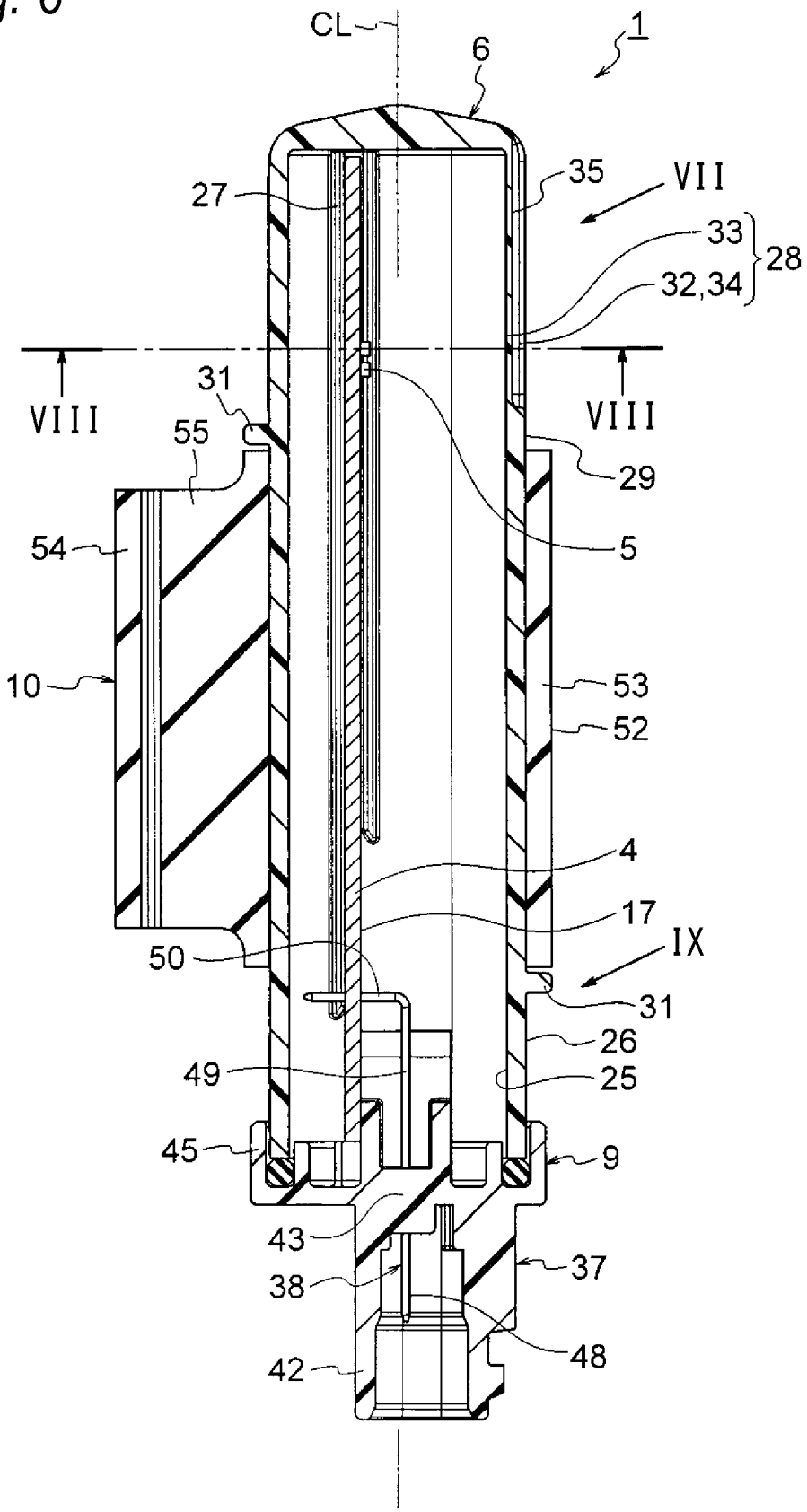
FIG. 6 is a cross-sectional view taken along a line VI-VI of FIG. 5A.
Figure 7:
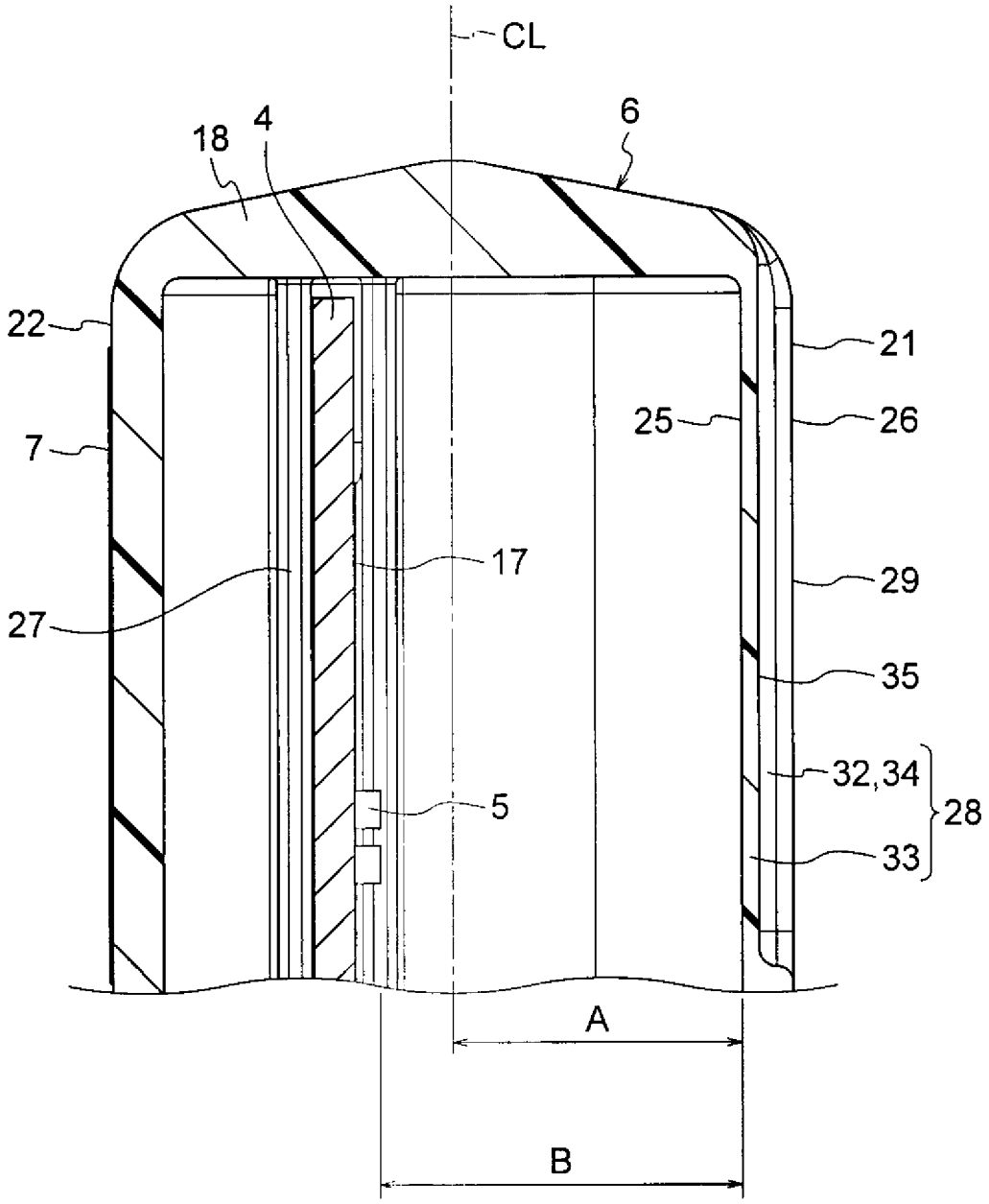
FIG. 7 is an enlarged view of a portion indicated by an arrow VII in FIG. 6.
Figure 8:
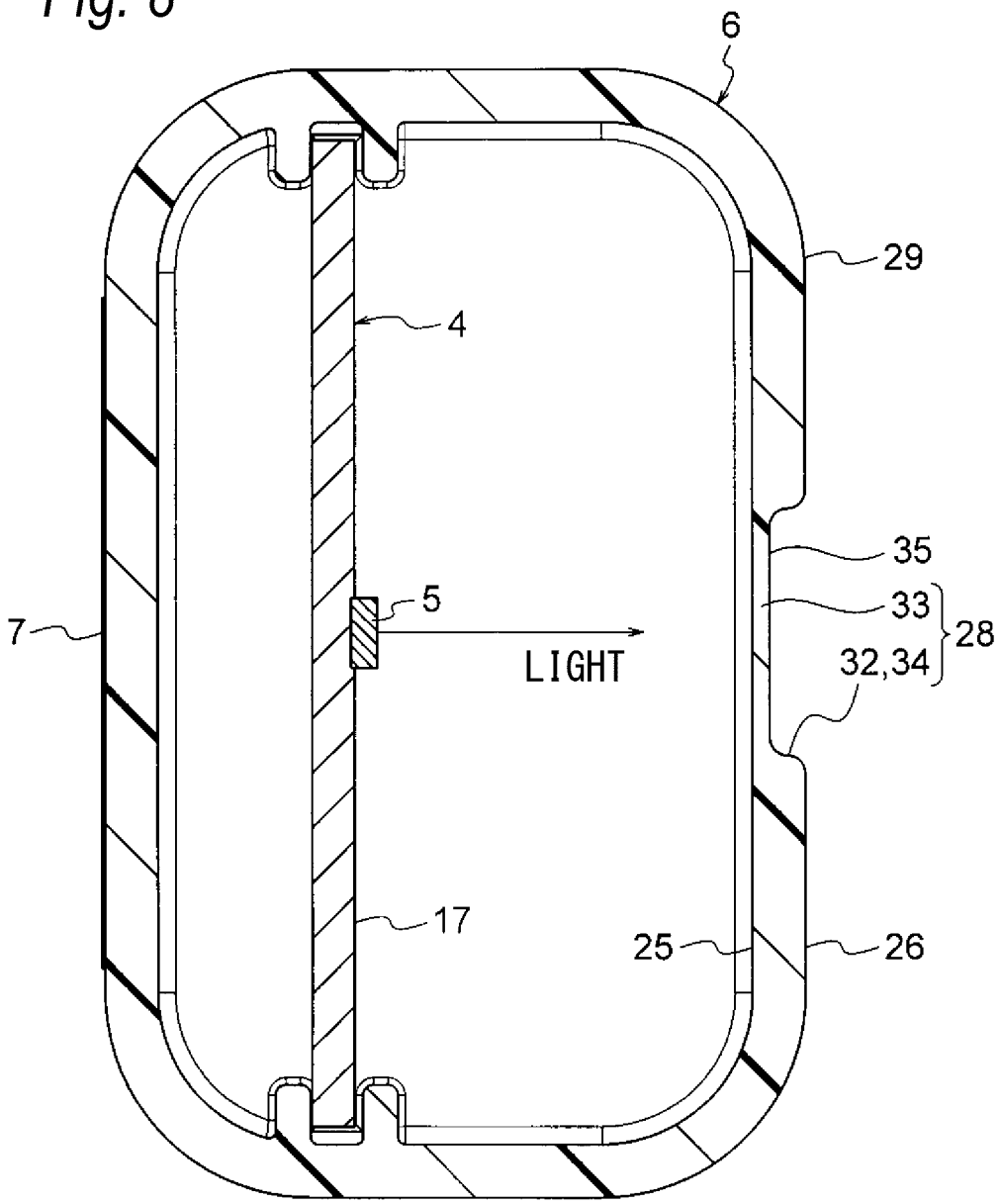
FIG. 8 is a cross-sectional view taken along a line VIII-VIII of FIG. 6.
Figure 9:
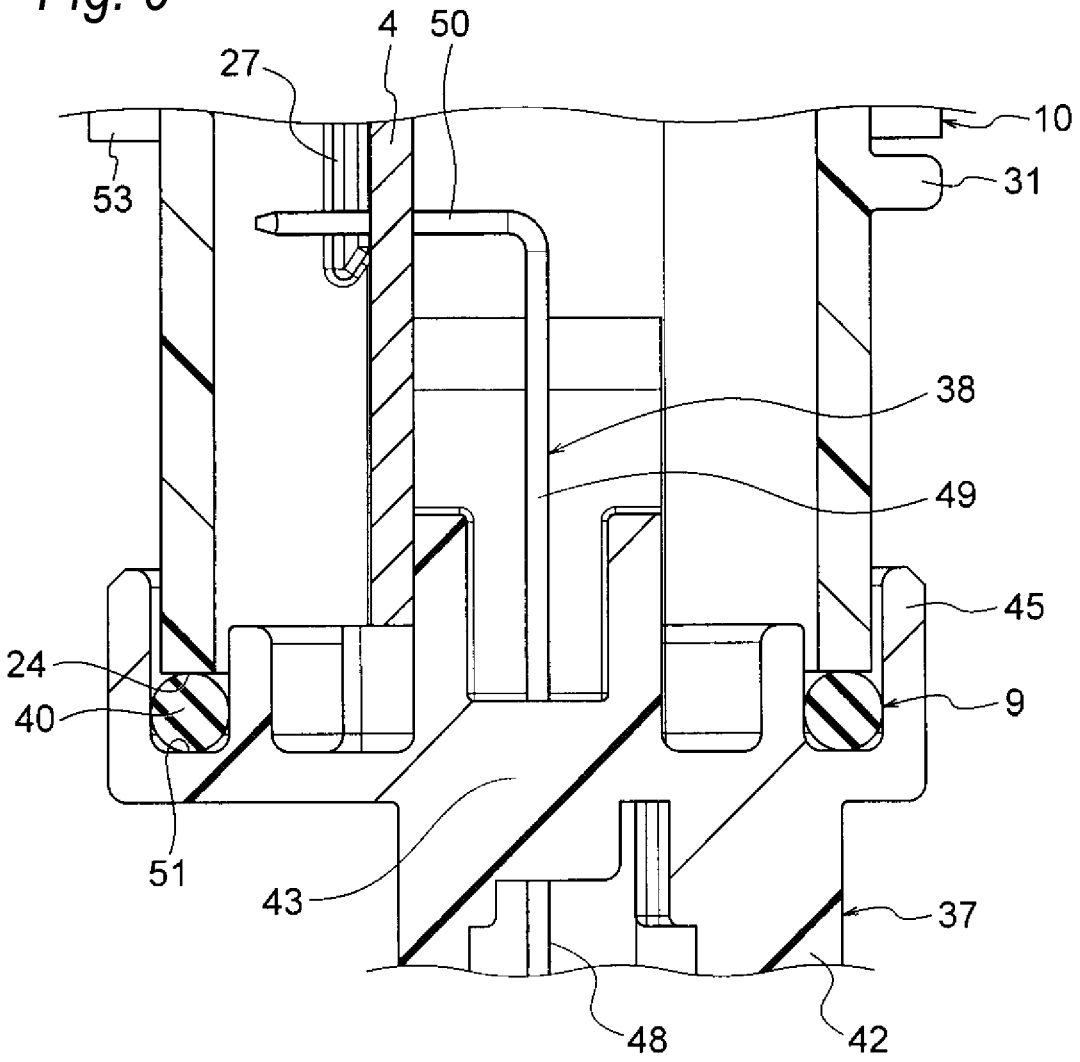
FIG. 9 is an enlarged view of a portion indicated by an arrow IX in FIG. 6.

Hereinafter, a first embodiment will be described with reference to drawings. FIG. 1 is a perspective view of a communication unit which is an embodiment of an electronic unit of the invention. FIG. 2 is an exploded perspective view of the communication unit, FIG. 3 is a perspective view of the communication unit as viewed from the front side, and FIG. 4 is a perspective view of the communication unit as viewed from the rear side. Further, FIG. 5A is a rear view of the communication unit, and FIG. 5B is a view before a holder is attached. FIG. 6 is a cross-sectional view taken along a line VI-VI of FIG. 5A, and FIG. 7 is an enlarged view of a portion indicated by an arrow VII in FIG. 6. FIG. 8 is a cross-sectional view taken along a line VIII-VIII of FIG. 6, and FIG. 9 is an enlarged view of a portion indicated by an arrow IX in FIG. 6.

Figure 10A:
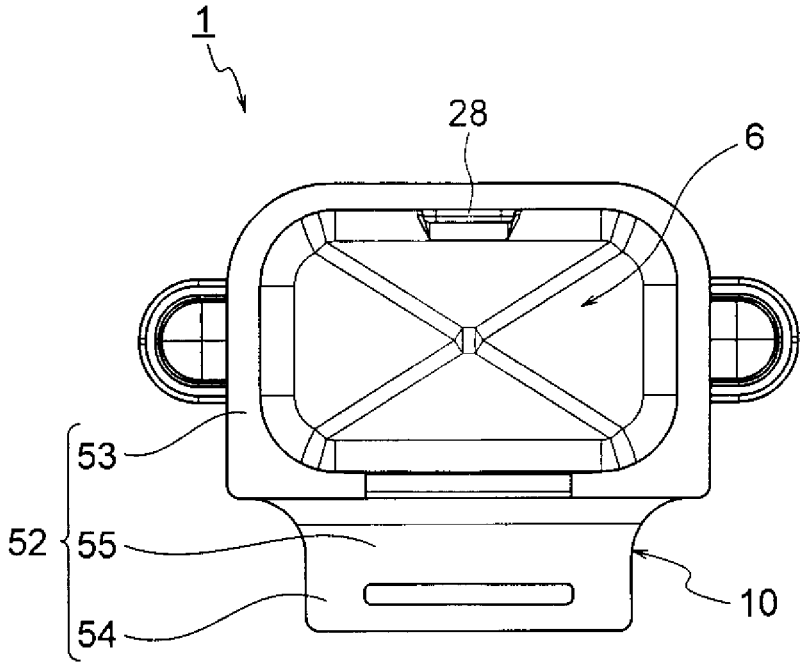
FIG. 10A is a plan view of the communication unit.
Figure 10B:
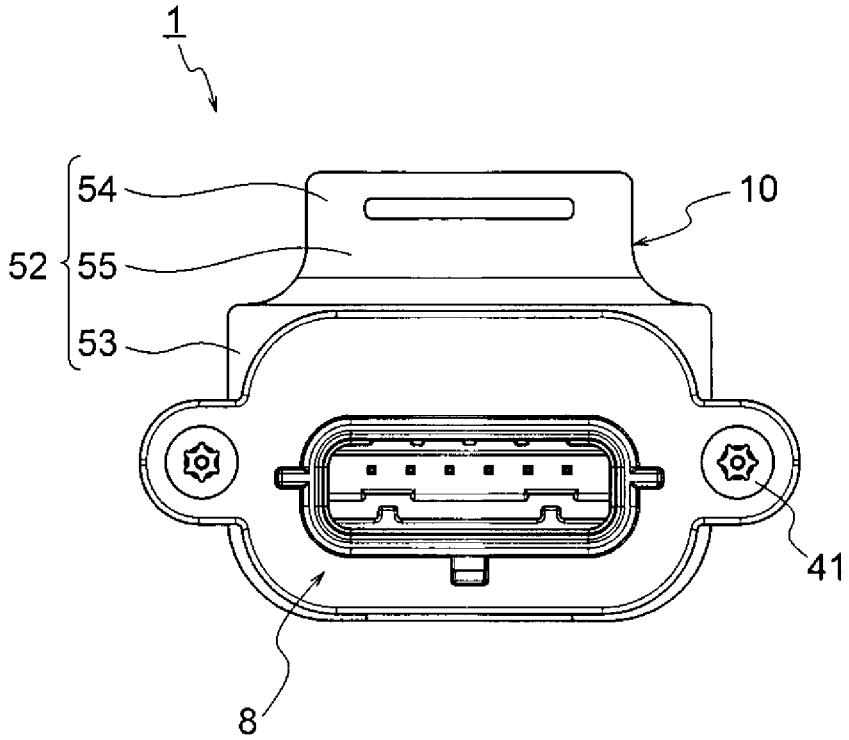
FIG. 10B is a bottom view of the communication unit.
Figure 11B:
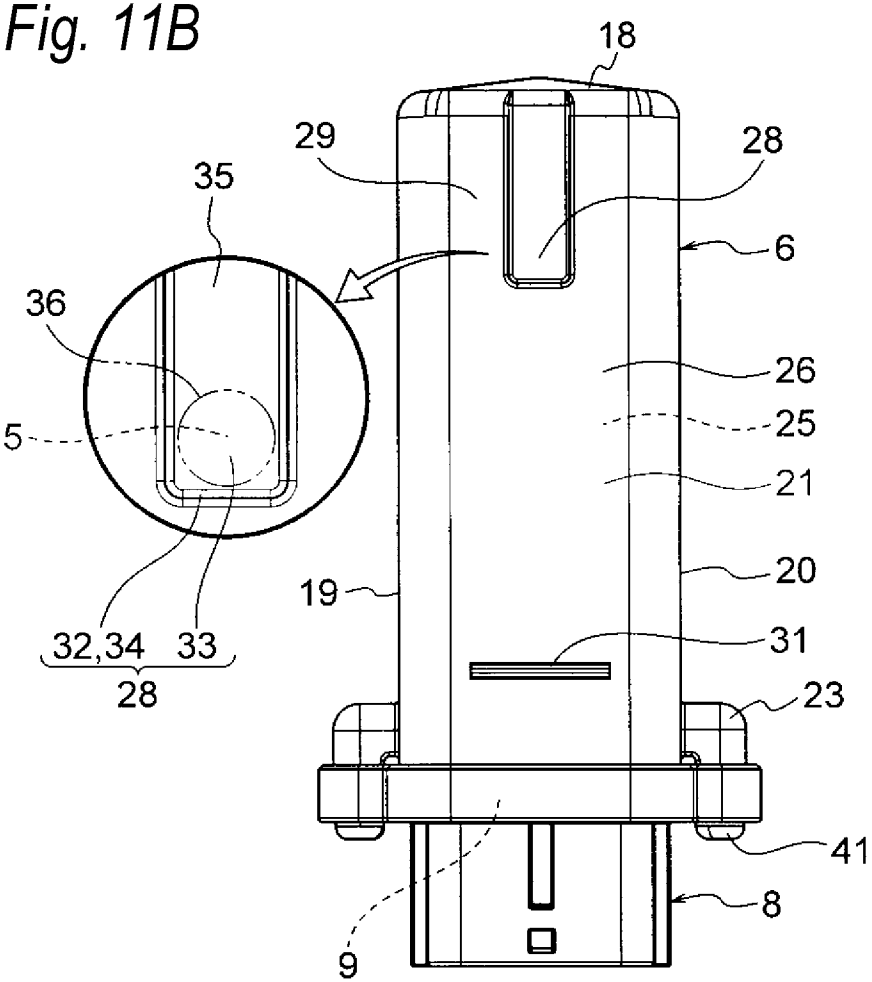
FIG. 11B is a view before the holder is attached.
Figure 11A:
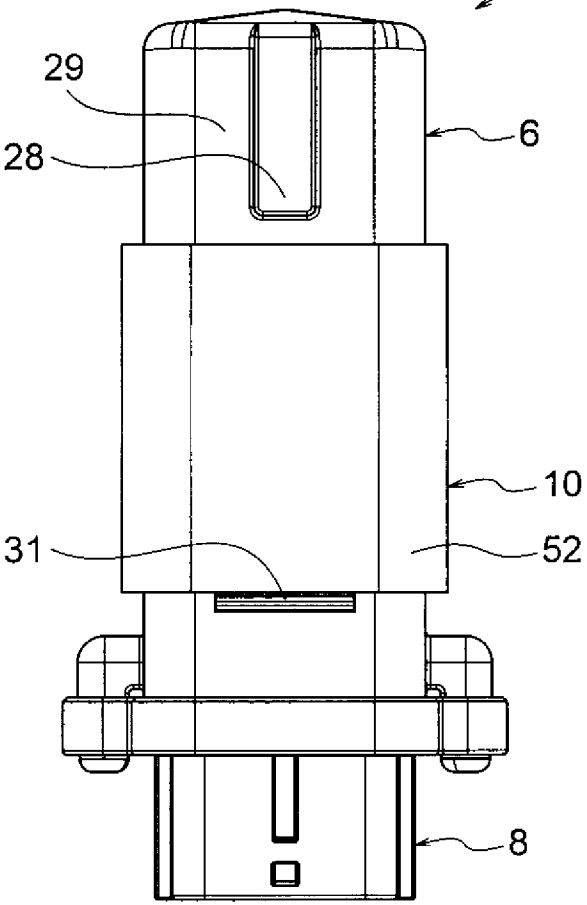
FIG. 11A is a front view of the communication unit.
Figure 12B:
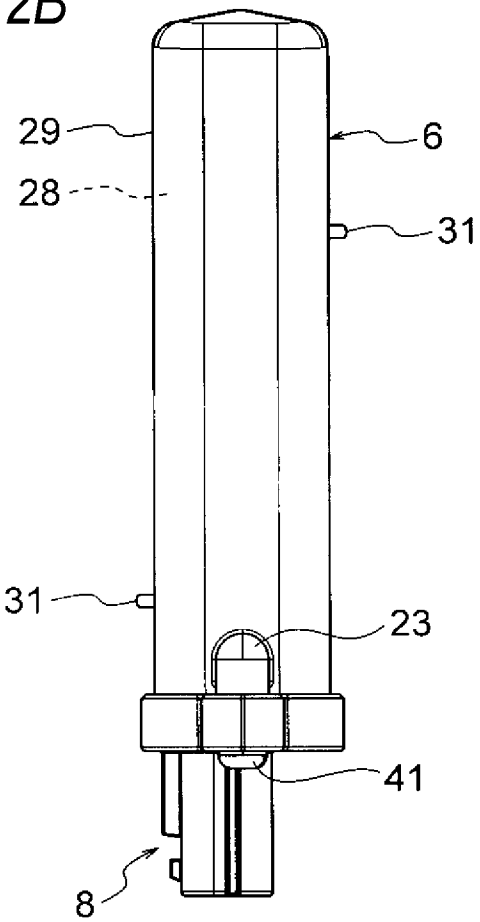
FIG. 12B is a view before the holder is attached.
Figure 12A:
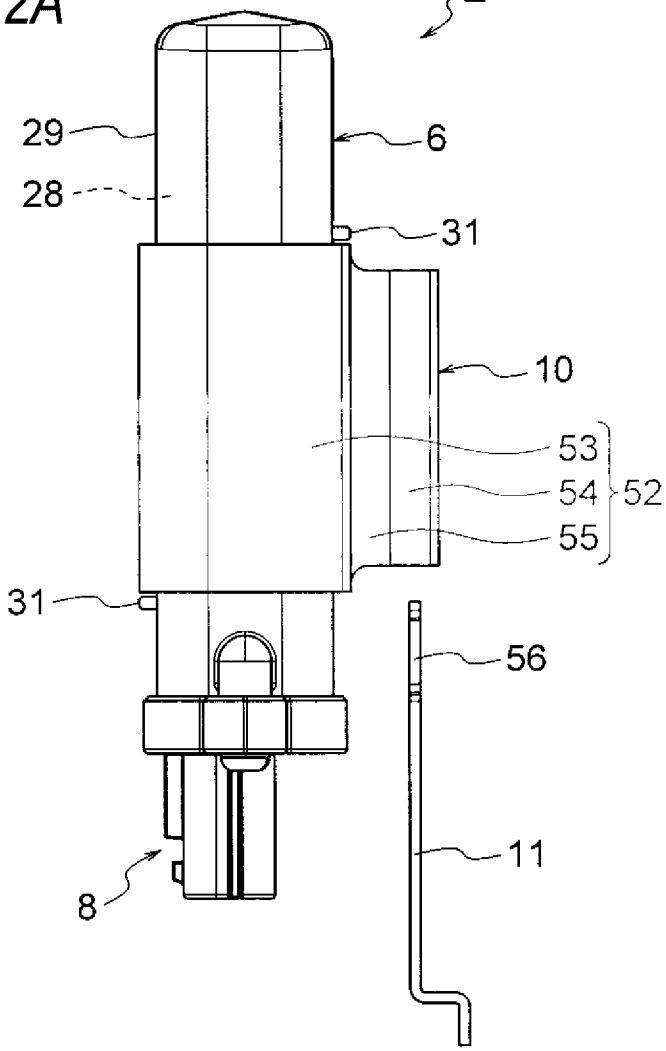
FIG. 12A is a side view of the communication unit.
Figure 13:
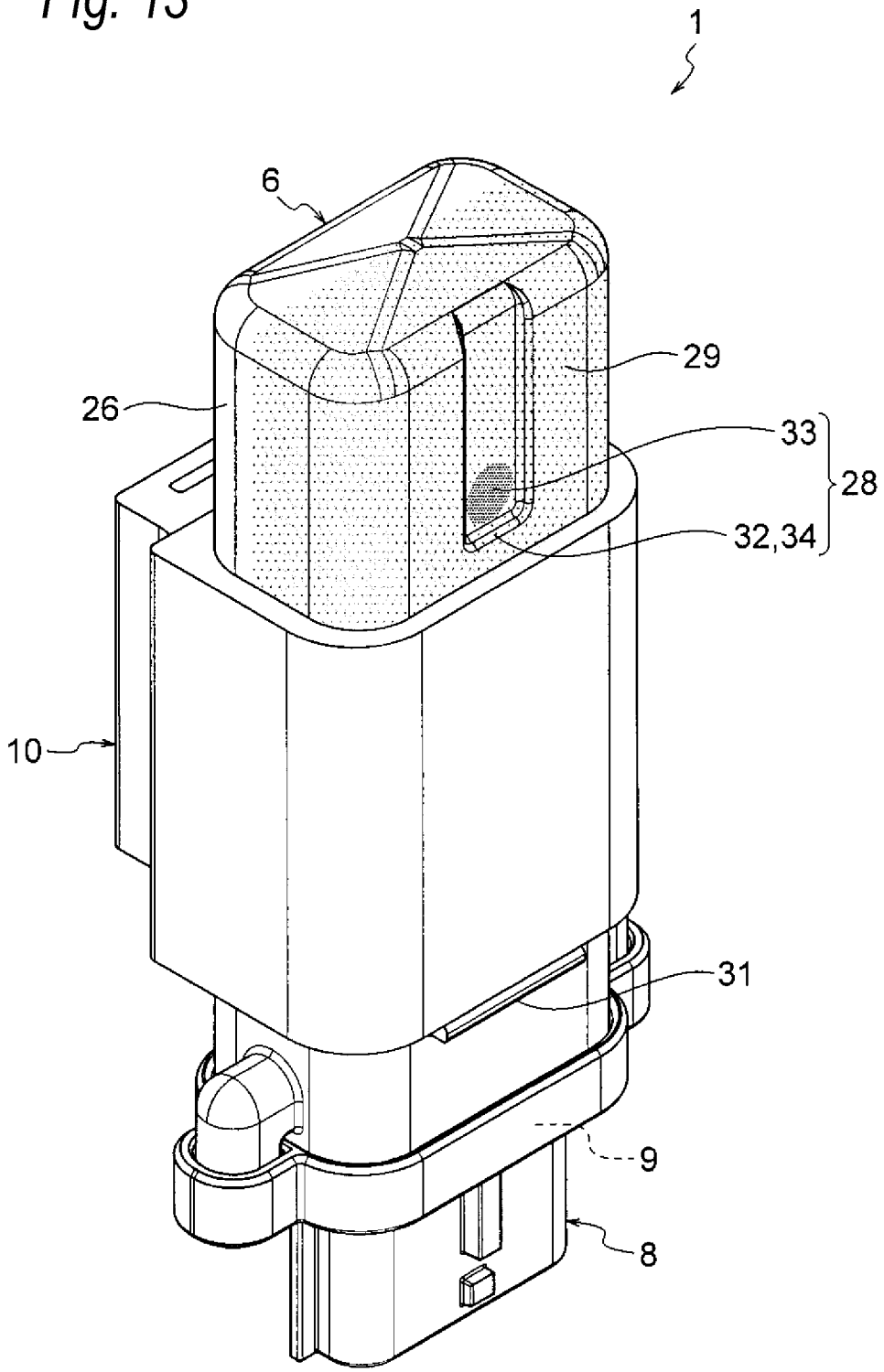
FIG. 13 is a perspective view illustrating an operating state (bright state) of the communication unit.

FIG. 10A is a plan view of the communication unit, and FIG. 10B is a bottom view of the communication unit. FIG. 11A is a front view of the communication unit, and FIG. 11B is a view before the holder is attached. FIG. 12A is a side view of the communication unit, and FIG. 12B is a view before the holder is attached. FIG. 13 is a perspective view illustrating an operating state (bright state) of the communication unit.

In FIGS. 1 and 2, a communication unit 1 (electronic unit) is connected to a mating connector 3 provided at the terminal of wire harness 2 and includes a circuit board 4, a light emitter 5, a resin case 6, a label 7, a board connector 8, a waterproof structure 9, and a holder 10. The communication unit 1 having the configuration described above is detachably attached to a bracket 11 (not illustrated) as a fixing target. First, the structure and the like of each of the above components will be described in detail.

In FIG. 1, a wire harness 2 is composed of a plurality of electrical wires 12 and an exterior 13 for bundling and protecting the plurality of electrical wires 12. The wire harness 2 is a branch line portion branched off from a trunk line or a dedicated line connecting a device (not shown) and the communication unit 1. The electrical wire 12 includes a conductor and an insulator. A general one is adopted as the electrical wire 12. The exterior 13 is, for example, a tape winding as illustrated in the drawings. For example, a corrugated tube may be adopted.

In FIGS. 1 and 2, the mating connector 3 includes a mating connector housing 14 which has insulation properties, a front holder 15 which is engaged with the mating connector housing 14, and a terminal fitting 16 which has conductivity and is accommodated in the mating connector housing 14. The mating connector 3 is provided as a connection destination of the board connector 8 of the communication unit 1 (detailed structural explanation will be omitted).

In FIGS. 2 and 6, the circuit board 4 is a printed circuit board having a desired pattern on a plate-shaped substrate having a rectangular shape in a plan view. Here, well-known one is adopted as the substrate. In the circuit board 4 of the embodiment, a communication part (not illustrated), an antenna, a light emitter 5, and the like are mounted. The circuit board 4 is configured so as to be capable of short-range wireless communication.

In FIGS. 2 and 6 to 8, the light emitter 5 is mounted at a desired position on one surface 17 of the circuit board 4. In this case, a well-known LED is adopted as the light emitter 5. The light emitter 5 is constituted of, for example, those capable of emitting red, green, or orange light. The light emitter 5 is mounted so as to emit the light in a direction perpendicular to the one surface 17. The light emitter 5 is disposed at a position so as to irradiate a portion in an inner surface 25 of the resin case 6 in which a light-transmission portion 28 (a first light-transmission portion) is disposed. The light emitter 5 is arranged at a position (A<B) where a distance B between the light emitter 5 and the light-transmission portion 28 is more than a distance A between the position of a central axis CL of the resin case 6 and the light-transmission portion 28. The arrangement in the drawings is an example. Further, regarding the arrangement will be explained not only here but also elsewhere.

In FIGS. 1 to 6, the resin case 6 is a resin molded product which is molded using a resin material such as a PP material or the like. Such a resin case 6 is formed in a shape capable of accommodating the circuit board 4 on which the light emitter 5 is mounted. In the embodiment, the resin case 6 is formed in a bottomed tubular shape. Also, the resin case 6 is formed in one-piece state. If the resin case 6 is formed into a case constituted of two separate parts, component management becomes complicated and a waterproof structure has to be added, and thus the resin case 6 in the one-piece state is optimal.

When, in the resin case 6, a portion corresponding to the "bottom" which is a bottomed portion is called a ceiling wall 18, the resin case 6 of the embodiment includes the ceiling wall 18, a left side wall 19, a right side wall 20, a front wall 21, and a rear wall 22 which are continuous to an edge portion of the ceiling wall 18, and a pair of screw fixing portions 23 and is formed in a shape illustrated in the drawings. A more detailed description of the shape will be given, the ceiling wall 18 is formed in a substantially rectangular shape having a pair of long sides and short sides. In addition, the front wall 21 and the rear wall 22 are formed in portions continuous to the pair of long sides. Each continuous portion from the ceiling wall 18 to the rear wall 22 is formed as a curved surface.

The pair of screw fixing portions 23 are formed in a portion where the left side wall 19 and the right side wall 20 bulge outward and a portion where screws 41 described below can be screwed and fixed. The end portions of the pair of screw fixing portions 23 and the opening portion 24 of the resin case 6 are arranged at the same position. In addition, a reference numeral 25 in the resin case 6 indicates an inner surface of the resin case 6. Further, a reference numeral 26 indicates an outer surface of the resin case 6.

The resin case 6 includes a pair of substrate guiding portions 27 on the inner surface 25. The resin case 6 also includes a light-transmission portion 28, a second light-transmission portion 29, a label pasting portion 30, and a pair of stopper portions 31.

In FIGS. 6 to 8, the pair of substrate guiding portions 27 are formed on the inner surface 25 of the left side wall 19 and the right side wall 20, respectively. The pair of right and left substrate guiding portions 27 are formed in two protruding portions which guide the side portion of the circuit board 4. Further, the pair of right and left substrate guiding portions 27 are formed in such a portion that the interval between the two protruding portions described above becomes slightly narrow toward the ceiling wall 18 side and the circuit board 4 can be held by press fitting. In this embodiment, the pair of right and left substrate guiding portions 27 are formed to be arranged so that the circuit board 4 can be accommodated and arranged further on the rear wall 22 side than the position of a central axis CL of the resin case 6. By forming at such a position, L-shaped terminals 38 of the board connector 8, which will be described below, can be arranged in accordance with the position of the central axis CL.

In FIGS. 1 to 3, 6 to 8, and 11A and 11B, the light-transmission portion 28 is formed as a portion in which the inner surface 25 is irradiated by lights of the light emitter 5 and which can secure desired luminance when viewed from the outside. Such a light-transmission portion 28 includes an outer-surface-side concave portion 32, a thin portion 33, and a marking portion 34 and is formed in a shape illustrated in the drawings. The light-transmission portion 28 is formed as a part for recognizing the operating state of the communication unit 1 at a glance.

Hereinafter, each part of the light-transmission portion 28 will be described in detail. Then, the second light-transmission portion 29 and the like will be described in order.

In FIGS. 6 to 8, the outer-surface-side concave portion 32 is formed on the front wall 21 of the resin case 6. Further, the outer-surface-side concave portion 32 is formed as a shape that recesses the outer surface 26 of the resin case 6. In other words, the outer-surface-side concave portion 32 is formed in such a shape that the outer surface 26 is lowered by one level. The outer-surface-side concave portion 32 extends along the central axis CL of the resin case 6 and is formed in a rectangular recessed portion such that the recess reaches the edge of the ceiling wall 18. Itis possible to simplify the structure of the metal mold used for resin molding as long as it has such a shape as above. In the outer-surface-side concave portion 32, the inside of the range of a circle 36 (see FIGS. 11A and 11B) of a double-dotted line in a flat bottom surface 35 functions as a portion for ensuring desired luminance when viewed from the outside. In the outer-surface-side concave portion 32, the width of the bottom surface 35 (the width in a right-left direction) is set in consideration of the range of the circle 36 of the double-dotted line. The circle 36 has the size of about $\phi 7$ in the embodiment.

In FIGS. 6 to 8, the thin portion 33 is formed as a portion between the bottom surface 35 of the outer-surface-side concave portion 32 and the inner surface 25 of the resin case 6. The thin portion 33 is formed at a thin place because the outer-surface-side concave portion 32 is formed by recessing the front wall 21 of the resin case 6. The thin portion 33 is formed to be thin enough to transmit the light from the light emitter 5 sufficiently. Further, even when it is formed to be thin, the strength thereof can be secured as the resin case 6.

In FIGS. 6 to 8, the marking portion 34 is formed as a marking portion in viewing with respect to the operating state of the communication unit 1. The marking portion 34 becomes an effective part to make it clear from where it should be seen at a glance. The marking portion 34 is formed as a portion which is also used as the outer-surface-side concave portion 32. The outer-surface-side concave portion 32 is formed as a rectangular recessed portion in the embodiment, and thus the marking portion 34 is relatively large in the front wall 21 of the resin case 6. Therefore, the marking portion 34 works well as a marker because it is easy to find due to the size.

In FIGS. 1 to 3, 6 to 8, and 11A and 11B, the second light-transmission portion 29 is formed around the light-transmission portion 28. Although the second light-transmission portion 29 transmits the light of the light emitter 5 is formed so as to have luminance lower than the luminance of the light-transmission portion 28. Since the second light-transmission portion 29 is not thin like the light-transmission portion 28 and the thickness of the front wall 21 corresponds to the thickness of the second light-transmission portion 29, it is a portion with lower luminance than the luminance of the light-transmission portion 28. Also, since the second light-transmission portion 29 is more distant from the light emitter 5 than the light-transmission portion 28 located directly above the light emitter 5, the second light-transmission portion 29 is a portion with lower luminance than that of the light-transmission portion 28. The second light-transmission portion 29 is formed as a portion which makes the circumference of the light-transmission portion 28 vaguely bright. In the embodiment, the outside of the circle 36 of the double-dotted line on the bottom surface 35 of the outer-surface-side concave portion 32 corresponds to the second light-transmission portion 29. However, there is a distance from the light emitter 5, and thus, even when the second light-transmission portion 29 is thin, the second light-transmission portion 29 becomes a part with slightly lower luminance than that of the inner side of the range of the circle 36.

By having the second light-transmission portion 29, the resin case 6 has a structure in which it is not necessary to provide a portion for light shielding on the inner surface 25 side of the resin case 6. Therefore, the resin case 6 simplifies the structure and contributes to the reduction of mold cost.

In FIGS. 4 to 8, the label pasting portion 30 is formed as a portion to paste the label 7. The label pasting portion 30 is formed on the rear wall 22 of the resin case 6. The label pasting portion 30 is formed in such a shape that it has the same shape as the rectangular label 7 and is recessed by the thickness of the label 7. The label pasting portion 30 is formed on an opposite side of the light-transmission portion 28 in the embodiment. When it is not necessary to paste the label 7, the label pasting portion 30 is not formed.

In FIGS. 1 to 5B, the pair of stopper portions 31 are formed on the outer surface 26 of the resin case 6. The pair of stopper portions 31 are formed as a positioning portion with respect to the holder 10. The pair of stopper portions 31 are formed in a rib-shaped portion having a substantially triangular cross section and extending in the right-left direction. In the embodiment, the pair of stopper portions 31 are respectively formed in the front wall 21 and the rear wall 22 of the resin case 6. The stopper portion 31 of the front wall 21 is formed on the opening portion 24 side of the resin case 6. The stopper portion 31 of the rear wall 22 is disposed below the label pasting portion 30 of the resin case 6. The pair of stopper portions 31 can contribute to attach the communication unit 1 to a predetermined position with respect to a fixing target (not illustrated).

In FIGS. 1 to 6, and 9, the board connector 8 includes a housing 37, the plurality of L-shaped terminals 38, screws 39 for fixing the substrate, a sealing member 40, and screws 41 for engagement of the resin case. The board connector 8 is formed as an electrical connection portion to the mating connector 3 and a member to be engaged with the opening portion 24 of the resin case 6. The portion where the board connector 8 and the opening portion 24 of the resin case 6 adhere to each other in a watertight manner corresponds to waterproof structure 9.

In FIGS. 1 to 6, and 9, the housing 37 is a resin molded article which is molded using a resin material having insulating properties. Such a housing 37 includes a connector engaging portion 42, a terminal fixing portion 43, a substrate engaging portion 44, and a resin case engaging portion 45.

The connector engaging portion 42 is formed in a portion to be engaged with the mating connector housing 14. The terminal fixing portion 43 is formed in a portion to which the plurality of L-shaped terminals 38 are watertightly fixed by insert molding. For example, it may be fixed watertight by potting or the like. In the insert molding describe above, for example, insert molding is effective in which a surface of a middle portion 49 of the L-shaped terminal 38, which will be described below, is roughened and resin material enters the roughened portion to be watertightly fixed.

The substrate engaging portion 44 is formed in a portion fixed to the circuit board 4 with the screw 39. In addition, the resin case engaging portion 45 is formed in a portion to be fixed to the resin case 6 with the screw 41. Both the substrate engaging portion 44 and the resin case engaging portion 45 are formed to include a pair of screw fixing portions (reference numerals omitted).

In FIGS. 2, 6, and 9, the L-shaped terminal 38 is a terminal formed by bending a conductive pin-shaped member into an L shape. Such an L-shaped terminal 38 includes an electrical contact portion 48 which protrudes into the connector engaging portion 42, the middle portion 49 which is insert-molded in the terminal fixing portion 43, and a circuit connecting portion 50 connected to the circuit board 4. In the L-shaped terminal 38, the electrical contact portion 48 and the middle portion 49 are arranged in accordance with the position of the central axis CL of the resin case 6. This arrangement has the advantage in that electrical connection with the mating connector 3 can be made along the central axis CL of the resin case 6.

In FIGS. 2, 6, and 9, the sealing member 40 is a rubber member which has a circular cross section and is formed into a ring shape. Such a sealing member 40 is accommodated in an annular groove 51 formed in the resin case engaging portion 45. The sealing member 40 is interposed and compressed between the groove bottom of the annular groove 51 and the opening portion 24 of the resin case 6. Therefore, by being compressed, entry of moisture in this portion can be prevented. The sealing member 40 is provided as a component of the waterproof structure 9. The waterproof structure 9 such as the sealing member 40 prevents entry of moisture into the resin case 6.

In FIGS. 1 to 13, the holder 10 is a member detachably attached to a bracket 11 (not illustrated) as a fixing target as described above. Such a holder 10 is constituted only by a holder body 52 of rubber. On the other hand, in a holder 10' of a second embodiment described below, in addition to the holder body 52, a cover portion 58 formed with a through hole 57 and the like are provided. The holder body 52 is formed in the illustrated shape having a case mounting portion 53, a bracket mounting portion 54, and a vibration absorbing portion 55.

case mounting portion 53 is attached to a body outer surface (the outer surface 26 of the middle portion of the resin case 6) of the resin case 6. Such a case mounting portion 53 is formed in a cylindrical portion. The inner size of the case mounting portion 53 is formed to be slightly smaller than the size of the outer surface 26 of the resin case 6. When the case mounting portion 53 is attached to the resin case 6, the case mounting portion 53 is attached in such a manner as to expand the cylindrical portion.

The bracket mounting portion 54 is formed in such a portion that the bracket 11 passes therethrough, and therefore attachment is completed. Further, the bracket 11 is formed in a metallic rigid band plate shape (see FIG. 2). In addition, the bracket 11 is formed in a shape having a pair of hook portions 56 (see FIG. 2) for preventing disengagement from the bracket mounting portion 54 at a tip end.

The vibration absorbing portion 55 is formed as a thick portion disposed between the case mounting portion 53 and the bracket mounting portion 54. The vibration absorbing portion 55 is effective for, for example, absorbing vibrations from a fixing target (not illustrated) having the bracket 11 so as not to transmit the vibrations to the communication unit 1.

In the configuration and the structure described above, in the communication unit 1, the outer surface 26 of the resin case 6 is recessed to form an outer-surface-side concave portion 32, and the outer-surface-side concave portion 32 also functions as the marking portion 34, and thus it becomes easy to recognize where a user should look at a glance. By looking at the outer-surface-side concave portion 32, the operating state of the communication unit 1 can be recognized at a glance from a state of the light-transmission portion 28 including the outer-surface-side concave portion 32. Specifically, the operating state of the communication unit 1 can be recognized by a state where the light-transmission portion 28 is bright or a state where the light-transmission portion 28 is not bright (see FIG. 3). In FIG. 13, a portion illustrated by a dark screen tone indicates of a portion which is bright when the light-transmission portion 28 is bright. Alternatively, the operating state of the communication unit 1 can be recognized from a state where the light-transmission portion 28 is brightened to green, red, or orange, or the like. In FIG. 13, a portion illustrated by a thin screen tone indicates of a portion which is bright when the light-transmission portion 28 is brightened to green, red, or orange. In addition, since the communication unit 1 includes the second light-transmission portion 29, the periphery of the light-transmission portion 28 becomes vaguely bright. As a result, visibility improves and the operating state becomes easy to recognize. By making the brightness strong enough to be visible in a wide range, the operating state of the communication unit 1 becomes easy to recognize.

As described above with reference to FIGS. 1 to 13, the light-transmission portion 28 and the second light-transmission portion 29 have an effect that the operating state of the communication unit 1 can be recognized at a glance.

In addition, since the communication unit 1 includes the waterproof structure 9, it is possible to prevent moisture from entering the resin case 6, and therefore it is possible to achieve an effect that the influence of the moisture on the circuit board 4 accommodated in the resin case 6 can be prevented.

Figure 14B:
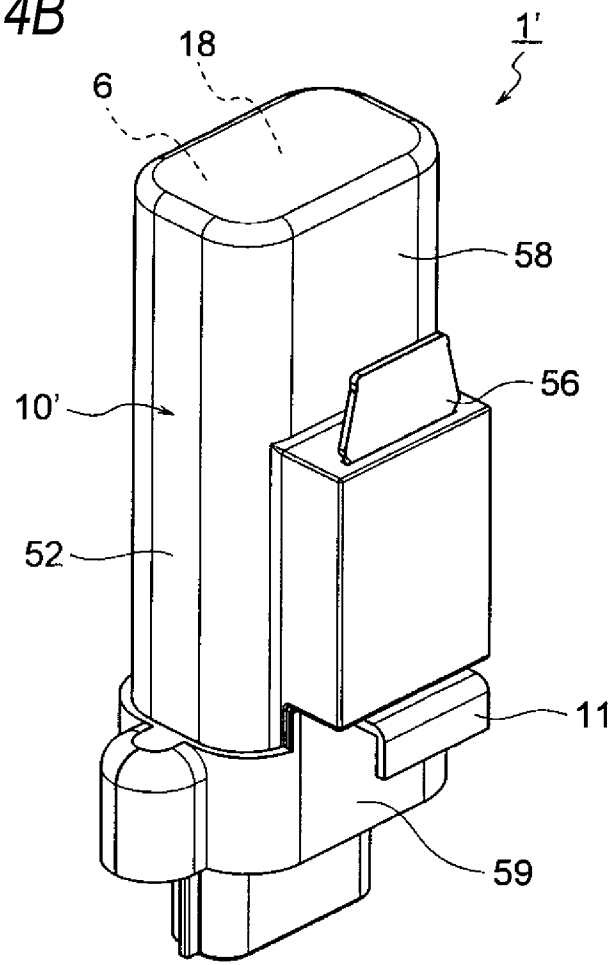
FIGS. 14A and 14B are perspective views of a communication unit according to the other embodiment of the electronic unit of the invention (Second embodiment).
Figure 14A:
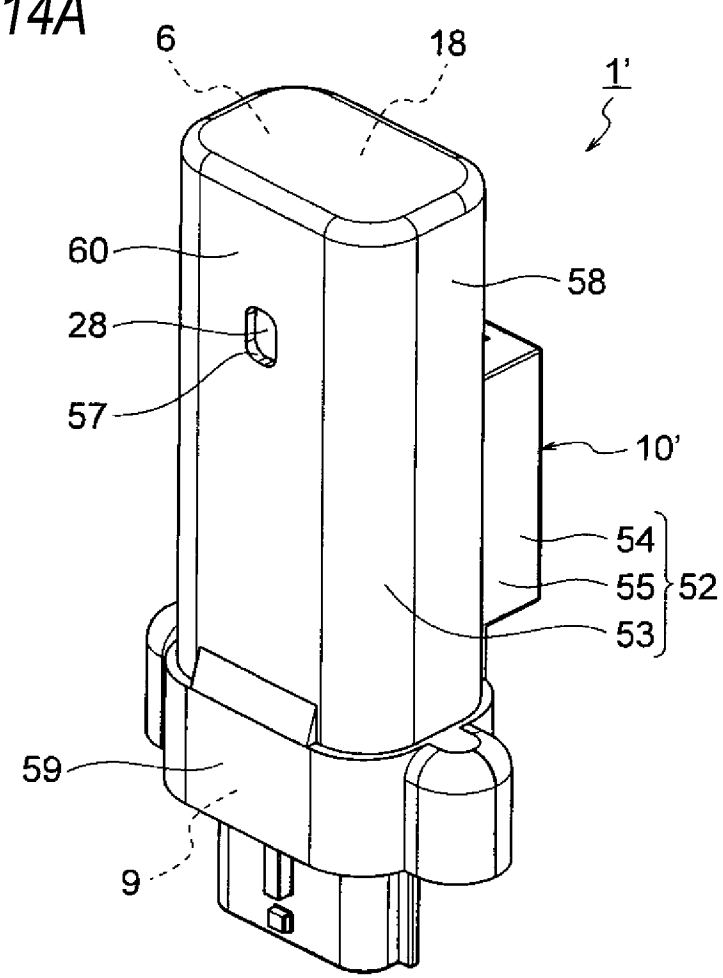

The second embodiment will be described with reference to the drawings. FIGS. 14A and 14B are perspective views of a communication unit according to the other embodiment of the electronic unit of the invention. The same reference numerals are given to the components that are basically the same as those in the first embodiment described above and a detailed description thereof will not be repeated.

In FIGS. 14A and 14B, a communication unit 1' (electronic unit) of the second embodiment has a configuration in which the rubber holder 10 (see FIG. 1) of the first embodiment is replaced with a rubber holder 10'. Hereinafter, the holder 10' will be described.

In FIGS. 14A and 14B, the holder 10' includes the holder body 52, the cover portion 58 with the through hole 57 formed therein, and a waterproof cover portion 59 and has a shape as illustrated in the drawings. The holder body 52 is basically the same as that of the first embodiment and includes the case mounting portion 53, the bracket mounting portion 54, and the vibration absorbing portion 55. The cover portion 58 and waterproof cover portion 59 are coupled to the case mounting portion 53. The cover portion 58 is formed in a portion covering the ceiling wall 18 side of the resin case 6. The through hole 57 is formed to penetrate the front portion 60 of the cover portion 58 so as to be able to face only the light-transmission portion 28. The waterproof cover portion 59 is formed in a portion covering the waterproof structure 9.

In the configuration and structure described above, in the communication unit 1', the operating state of the communication unit 1' can be recognized at a glance from the state of the light-transmission portion 28 facing the through hole 57. Specifically, the operating state of the communication unit 1' can be recognized by a state where the light-transmission portion 28 is bright or a state where the light-transmission portion 28 is not bright. Alternatively, the operating state of the communication unit 1' can be recognized from the state where the light-transmission portion 28 is brightened to green, red, or orange, and the like.

As described above with reference to FIGS. 14A and 14B, it is possible to achieve an effect that the operating state of the communication unit 1' can be recognized at a glance with the light-transmission portion 28.

Furthermore, it is needless to say that the invention can be variously modified within a range not changing the gist of the invention.

In the above description, the communication unit 1 (1') is exemplified as the electronic unit because the circuit board 4 for communication is provided, but it is not limited to the use for communication. It may be an electronic unit in which a unit operating state can be recognized at a glance from the state of the light-transmission portion 28.

Here, the features of the embodiment of the electronic unit according to the invention described above are summarized briefly in (1) to (9) described below.

(1) An electronic unit 1, 1' including:

a circuit board 4;

a light emitter 5 mounted on one side of the circuit board 4 and configured to emit a light; and a resin case 6 accommodating the circuit board 4 on which the light emitter 5 is mounted, wherein the resin case 6 includes a first light-transmission portion 28 configure to transmit the light emitted from the light emitter 5 to outside of the resin case 6 so as to be bright in desired luminance when viewed from the outside, and the first light-transmission portion 28 includes an outer-surface-side concave portion 32 which is formed by recessing an outer surface of the resin case 6 so that a thickness of the first light-transmission portion 28 is thinner than a thickness of the resin case 6 except for the first light-transmission portion 28.

(2) The electronic unit according to (1), wherein the outer-surface-side concave portion 32 is indicative of a position of the first light-transmission portion.

(3) The electronic unit according to (1), wherein a distance B between the light emitter 5 and an inner surface 25 of the first light-transmission portion 28 is longer than a distance A between a central axis CL of the resin case 6 and the inner surface 25 of the first light-transmission portion 28.

(4) The electronic unit according to (1), wherein the resin case 6 is resin-molded into a bottomed tubular shape and a one-piece state.

(5) The electronic unit according to (3), wherein the resin case 6 includes a second light-transmission portion 29 which is provided around the first light-transmission portion 28, and the second light-transmission portion 29 is configured to transmit light emitted from the light emitter 5 to the outside of the resin case 6 so as to be bright in a luminance lower than the desired luminance.

(6) The electronic unit according to (4), further including:

a housing 37 engaged with the resin case 6; and a sealing member 40 which is in close contact with an opening portion 24 of the resin case 6 and the housing 37 therebetween.

(7) The electronic unit according to (6), further including:

a rubber holder 10, 10' which is attached to an outer surface of a body of the resin case 6 and detachable with respect to a bracket as a fixing target.

(8) The electronic unit according to (7), wherein the resin case 6 includes a stopper portion 31 disposed in the outer surface of the resin case 6 and configured to position with respect to the holder 10, 10'.

(9) The electronic unit according to (7), wherein the holder 10, 10' includes a holder body 52, a cover portion 58 which covers an outside of the bottomed portion of the resin case 6, and a through hole 57 exposing the first light-transmission portion 28 to the outside of the cover portion 58 is formed in the cover portion 58.

According to the invention, the outer surface of the resin case is recessed to form the outer-surface-side concave portion and the outer-surface-side concave portion functions as a marker, and thus it is possible to recognize where a user should look at a glance. By looking at the outer-surface-side concave portion, the operating state of the electronic unit can be recognized at a glance from a state of the light-transmission portion including the outer-surface-side concave portion. The state of the light-transmission portion may be, for example, a state where the bottom surface of the outer-surface-side concave portion in the light-transmission portion is bright or not bright, or a state where the bottom surface is brightened to green, red, or orange, and the like.

According to the invention, for example, it is possible to provide a structure that one end side of the L-shaped terminal is connected to the circuit board and the other end side (electrical connection portion with a mating terminal) of the L-shaped terminal is arranged in accordance with the central axis of the resin case. According to the invention, in order to illuminate the inner surface of the resin case with lights from the light emitter, it is possible to have a structure in which a light emitter is not required to be arranged close to the inner surface.

According to the invention, it is possible not only to make it easy to manage parts by minimizing the number of parts, but also to be able to contribute to provide waterproof properties because it does not have a two-divided structure.

According to the invention, it is possible to brighten the bottom surface of the outer-surface-side concave portion in the light-transmission portion at desired luminance, and further, since the surroundings of the light-transmission portion becomes a second light-transmission portion, the second light-transmission portion can make the surroundings of the light-transmission portion, for example, vaguely bright. That is, by making the brightness strong and weak, it is possible to recognize the operating state of the electronic unit at a glance over a wide range.

According to the invention, the opening portion of the resin case can have waterproof properties. It is possible to prevent entry of moisture into the resin case, so that it is possible to prevent the influence of the moisture on the circuit board accommodated in the resin case.

According to the invention, it is possible not only to have a detachable function with respect to the fixing object but also to be able to absorb a vibration with the holder portion even when there is, for example, a vibration generating source on the fixing target side. That is, it is possible not to transmit the vibration to an electronic unit body so as not to cause influence.

According to the invention, it is possible to attach the electronic unit so as to be located at a predetermined position with respect to the fixing target.

According to the invention, by including the cover portion having the through hole to the configuration of the holder, it is possible to recognize the operating state even with only the light-transmission portion being visually recognized.

According to an electronic unit of the invention, it is possible to achieve an effect that an operating state can be recognized at a glance.

What is claimed is:

1. An electronic unit comprising:

a circuit board;

a light emitter mounted on one side of the circuit board and configured to emit a light; and a one-piece resin case accommodating the circuit board on which the light emitter is mounted, wherein the one-piece resin case includes a first light-transmission portion configured to transmit the light emitted from the light emitter to an outside of the one-piece resin case so as to be bright in desired luminance when viewed from the outside, the first light-transmission portion includes an outer-surface-side concave portion which is formed by recessing an outer surface of the one-piece resin case so that a thickness of the first light-transmission portion is thinner than a thickness of the one-piece resin case except for the first light-transmission portion, and the one-piece resin case is formed of a single homogeneous material.

2. The electronic unit according to claim 1, wherein the outer-surface-side concave portion is indicative of a position of the first light-transmission portion.

3. The electronic unit according to claim 1, wherein a distance between the light emitter and an inner surface of the first light-transmission portion is longer than a distance between a central axis of the one-piece resin case and the inner surface of the first light-transmission portion.

4. The electronic unit according to claim 1, wherein the one-piece resin case is resin-molded into a bottomed tubular shape.

5. The electronic unit according to claim 3, wherein the one-piece resin case includes a second light-transmission portion which is provided around the first light-transmission portion, and the second light-transmission portion is configured to transmit light emitted from the light emitter to the outside of the one-piece resin case so as to be bright in a luminance lower than the desired luminance.

6. The electronic unit according to claim 4, further comprising:

a housing engaged with the one-piece resin case; and a sealing member which is in close contact with an opening portion of the one-piece resin case and the housing therebetween.

7. The electronic unit according to claim 6, further comprising:

a rubber holder which is attached to an outer surface of a body of the one-piece resin case and detachable with respect to a bracket as a fixing target.

8. The electronic unit according to claim 7, wherein the one-piece resin case includes a stopper portion disposed in the outer surface of the one-piece resin case and configured to position with respect to the holder.

9. The electronic unit according to claim 7, wherein the holder includes a holder body, a cover portion which covers an outside of a bottomed portion of the one-piece resin case, and a through hole exposing the first light-transmission portion to the outside of the cover portion is formed in the cover portion so as to permit an operating state of the electronic unit to be visually recognized.

* * * * *